US006786164B2

(12) United States Patent
Myers et al.

(10) Patent No.: US 6,786,164 B2
(45) Date of Patent: Sep. 7, 2004

(54) RAW MATERIAL SUPPLY SYSTEM FOR QUILTING MACHINES

(75) Inventors: Terrance L. Myers, Coral Springs, FL (US); Jeff A. Kaetterhenry, Davie, FL (US)

(73) Assignee: L & P Property Management Company, South Gate, CA (US)

( * ) Notice: Subject to any disclaimer, the term of this patent is extended or adjusted under 35 U.S.C. 154(b) by 225 days.

(21) Appl. No.: 10/050,493

(22) Filed: Jan. 16, 2002

(65) Prior Publication Data

US 2003/0136319 A1 Jul. 24, 2003

(51) Int. Cl.[7] ..... D05B 11/00

(52) U.S. Cl. ..... 112/475.08; 112/117

(58) Field of Search ..... 112/117, 118, 112/119, 80.3, 303, 304, 305, 307, 312, 314, 318, 319, 470.31, 475.07, 475.08; 226/108, 110, 111, 112, 118.1, 118.4; 83/55, 56, 37; 242/166, 170, 551, 555, 556

(56) References Cited

U.S. PATENT DOCUMENTS

| | | | | |
|---|---|---|---|---|
| 1,194,254 A | | 8/1916 | Sumner | |
| 2,411,637 A | | 11/1946 | Ramage, Jr. | |
| 4,038,047 A | | 7/1977 | Haywood | |
| 4,702,184 A | | 10/1987 | Datlof | |
| 4,815,404 A | | 3/1989 | Ellermann et al. | |
| 5,022,336 A | | 6/1991 | Iwase | |
| 5,027,726 A | | 7/1991 | Brower et al. | |
| 5,154,130 A | | 10/1992 | Gribetz et al. | |
| 5,174,228 A | | 12/1992 | Grimnes | |
| 5,363,998 A | | 11/1994 | Tschiderer | |
| 5,511,500 A | * | 4/1996 | Conley, Jr. | 112/470.05 |
| 5,544,599 A | * | 8/1996 | Frazer et al. | 112/118 |
| 5,603,270 A | | 2/1997 | White et al. | |
| 5,685,250 A | | 11/1997 | Kaetterhenry et al. | |
| 5,913,277 A | * | 6/1999 | Resta | 112/470.12 |
| 5,974,993 A | * | 11/1999 | DeFranks et al. | 112/117 |
| 6,051,090 A | | 4/2000 | Healy et al. | |
| 6,105,520 A | * | 8/2000 | Frazer et al. | 112/117 |
| 6,123,038 A | | 9/2000 | Kames et al. | |
| 6,158,366 A | | 12/2000 | Codos | |
| 6,312,123 B1 | | 11/2001 | Codos et al. | |

* cited by examiner

*Primary Examiner*—Ismael Izaguirre
(74) *Attorney, Agent, or Firm*—Wood, Herron & Evans LLP

(57) ABSTRACT

A modular material supply system for an automated quilting machine having a variety of fill material supply devices, a cover material tick magazine, a fill laminator, and optionally a digital printer. The system is capable of selecting the desired cover and fill materials and supplying them continuously to a laminator to form a layered material, which is then fed to the quilting machine. The flexibility of the modular system reduces the need for system downtime to changeover component materials for producing different quilted products.

48 Claims, 4 Drawing Sheets

RAW MATERIAL SUPPLY SYSTEM FOR QUILTING MACHINES

FIELD OF THE INVENTION

This invention relates to quilting machines, and more particularly to a modular system for feeding materials into the quilting machines.

BACKGROUND OF THE INVENTION

Quilting machines are well known in the art and are used for making a variety of quilted products such as furniture coverings, mattress panels, and other quilted covers. One such quilting machine is described in U.S. Pat. No. 5,154,130 to Gribetz et al. and is incorporated herein by reference in its entirety. These quilting machines are utilized to sew together one or more layers of fill material between a fabric covering and a backing material whereby various stitch lines are created to form functional and decorative patterns in the finished product. Due to market demands for quilted products in a variety of colors and patterns, as well as in a range of quality and price, a single quilting machine is generally utilized to produce a wide variety of different quilted products. Accordingly, manufacturers must frequently change the cover and fill materials supplied to the quilting machine during production, often as much as several times a day.

The materials used in quilting machines fall into two general categories: cover materials and fill materials. Cover materials include the top layer fabric and the bottom layer backing. The fabric material may be provided in any of a variety of fabric textures, knits, colors, patterns, weights and weaves. Conventional quilting machines are supplied with fabric and backing materials on rolls mounted to the quilting machine. Fill materials, generally including foam materials and/or fiber materials, are also provided in rolls and are supplied at specific precut thicknesses for producing the range of quilted products. Rolls of fill material are generally placed on racks in front of the quilting machine and are fed into the quilting machine, along with the cover and backing materials, by feed rollers which pull the materials from the rolls. Multiple filler rolls, with various properties and thicknesses, may be combined to form a multi-layer "sandwich" of filler material between the cover materials.

To accommodate different products, a wide range of cover and filler materials must be stocked and available for use whenever a different final product is desired. For example, one production run might require a sandwich of a 2 inch layer of foam material and a 1 inch layer of fiber material between a beige cover material and white backing material. The next production run might require the foam material layer to be 1 inch thick and the fiber material layer to be 1.5 inch thick. The next production run might require that the beige cover material be changed to include a green floral pattern.

When changeover to produce a different quilted product is necessary during operation, a machine operator must stop the quilting machine, cut the current fabric and/or fill material rolls, remove the current roll or rolls, replace the rolls with the new desired fabric or fill rolls, and attach the new materials to the previous materials being fed into the quilting machine. These operations are highly labor intensive, requiring a significant amount of machine down time and physical exertion by an operator.

Another problem associated with conventional quilting machines is an undesirable stretching of material as they are fed into the quilting machine. This stretching is caused by tension generated as the infed materials are pulled from their respective rolls by the feed rollers on the quilting machine.

There is thus a need for a system for supplying materials to an automated quilting machine which provides a substantially continuous feed of fill and cover materials into the quilting machine and which reduces the time consuming and labor intensive process of changing over fill and cover material rolls to produce different quilted products during operation. There is also a need for a flexible, modular material supply system for automated quilting machines which is capable of accommodating infed materials in various forms for input to the quilting machine and which can provide fill and cover materials to the quilting machine in a manner that eliminates undesirable stretching of the materials.

SUMMARY OF THE INVENTION

The present invention provides a flexible, modular material supply system for an automated quilting machine which is capable of accommodating infed materials in various forms and which significantly reduces the time and effort needed to changeover component materials to produce various quilted products. To this end, the material supply system includes a variety of fill material supply devices which receive and dispense fill material in various forms. The fill material supply system includes one or more of the following devices: (a) a roll cradle for dispensing fill material from a roll; (b) a log peeler for receiving a solid foam log and dispensing foam fill material cut to a desired thickness; (c) a fan-folded fill device which dispenses a continuous web of fill material that has been folded with alternating folds into a cart or bale form; and (d) a fiber lay-down device which deposits fiber fill material directly onto an infed web of material at a desired thickness. Selection of infed fill materials from one or more of the above devices may be based, for example, on the desired quality and/or thickness of the final quilted product, or based on suitability for a given production run.

The material supply system of the present invention further includes an automated tick magazine, a backing material supply device, a laminator, and optionally a digital printer. The tick magazine stages, feeds, cuts, splices, and rewinds various fabric cover materials which are stored in a carousel-type holder. The backing supply device dispenses backing material in roll form. The laminator is located downstream of the fill supply devices, the tick magazine, and the backing supply device and selectively receives one or more fill materials, a cover material, and a backing material and channels them into a continuous layered workpiece. A digital printer may be located downstream from the laminator and receives the continuous layered workpiece to selectively print a variety of patterns and colors onto the fabric cover material, thereby reducing the quantity of fabric cover materials which must be stored in the tick magazine. Alternatively, a digital printer may be located adjacent the tick magazine upstream of the laminator to print onto the cover material prior feeding it to the laminator.

In one aspect of the invention, the laminator is equipped with a glue station which can be actuated to selectively bond components of the layered workpiece as desired. In a further aspect of the invention, the laminator includes cutting and splicing devices for selectively cutting out or splicing in the various component materials to produce a variety of layered workpieces. In still a further aspect of the invention, the laminator is equipped with a panel cutting device and a panel stacker for cutting individual panels of the layered workpiece and stacking them for presentation to the quilting machine.

In another aspect of the invention, the roll cradle includes powered rollers or a powered belt drive for dispensing fill material from a roll. The roll cradle may be further equipped with a sensor and a controller coupled to a belt drive motor for detecting tension in the dispensed fill material and adjusting the motor to eliminate the tension. In still another aspect of the invention, the roll cradle is equipped with a device which automatically cuts and splices the fill material.

Thus, the present invention provides an improved material supply system for automated quilting machines that reduces the substantial down time associated with changing over fill and cover materials being fed to the quilting machine, and further provides fill and cover materials to an automated quilting machine in a manner that eliminates undesirable stretching of fill materials.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
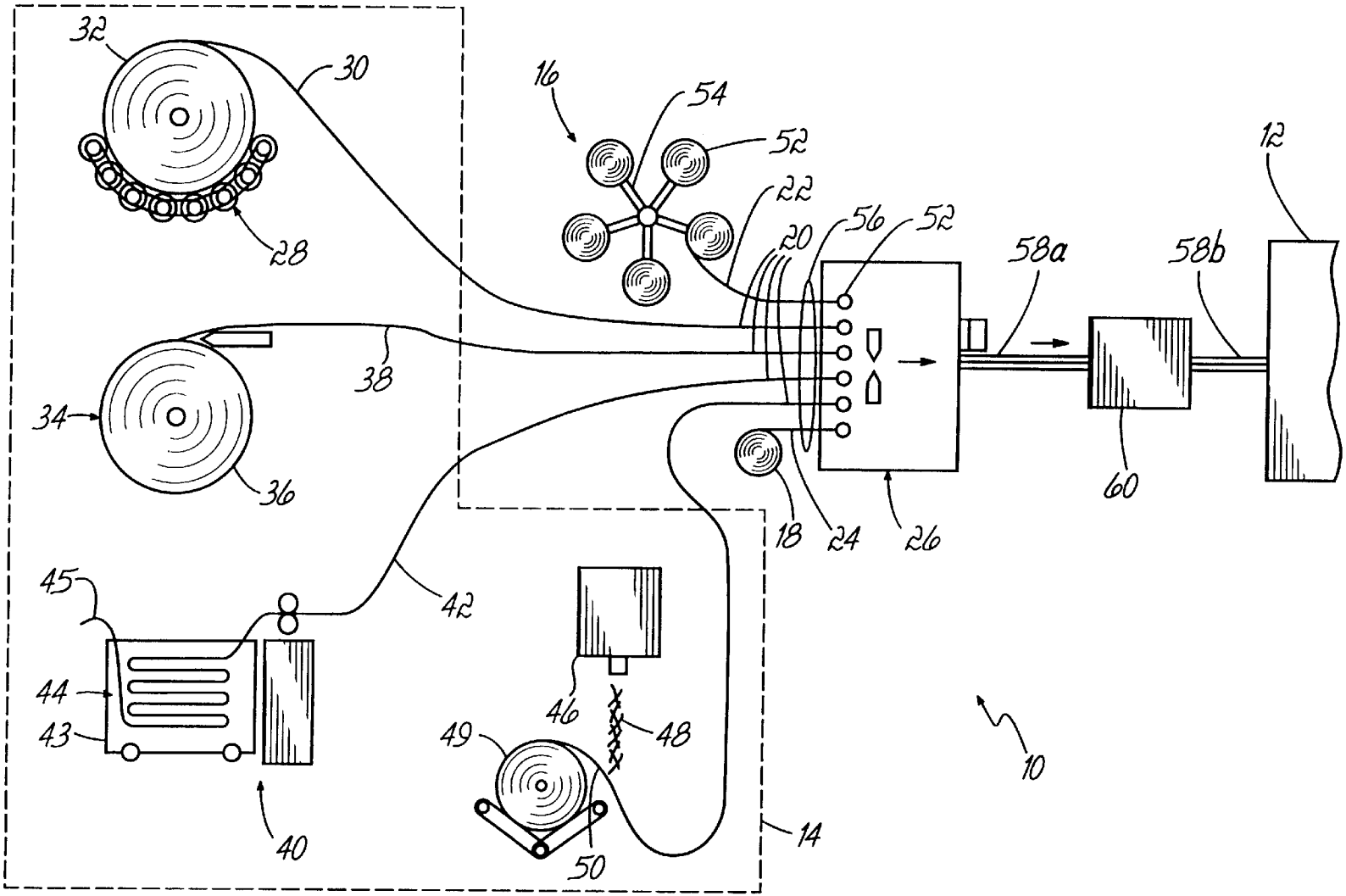
FIG. 1 is a schematic layout of a modular material supply system in accordance with the present invention.

The present invention provides a flexible, modular material supply system for automated quilting machines that accommodates infed materials in various forms for input to the quilting machine so as to accommodate individual manufacturers' needs. Referring to FIG. 1, a modular system 10 for supplying materials to an automated quilting machine 12 includes a fill material supply device 14, a cover material tick magazine 16, and a backing material supply feeder 18, which together supply fill material 20, cover material 22, and backing material 24 to a laminator 26. The laminator 26 processes the individual infed materials, collectively referred to as infeed web sandwich 56, into a layered workpiece 58 for presentation to quilting machine 12.

The fill material supply device 14 that supplies the fill material 20 to the laminator 26 includes: one or more roll cradles 28 for dispensing fill material 30 from a roll 32; and/or a log peeler 34 for receiving a solid foam log 36 and dispensing foam fill material 38 cut from log 36 to a desired thickness; and/or one or more fan-folded fill devices 40 that dispense a continuous web of fill material 42 that has been folded with alternating folds into a cart or bale form 44; and/or a fiber lay-down device 46 that deposits fiber fill material 48 at a desired thickness directly into the infeed web sandwich 56 that is directed to the laminator 26.

The roll cradles 28 are designed to easily accept pre-manufactured rolls of fill material, either foam or fiber or a combination thereof, without the need to mount them by means of a steel tube placed through the cores. Multiple roll cradles 28 may be provided to accommodate different types of fill material 30. The roll cradles 28 have an upwardly concave or v-shaped design which eliminates the need for manual tension devices that most core-mounted systems require to prevent the rolls 32 from over-running. Such manual tension devices induce unwanted stretch into the filler material 30 and require the operator to make adjustments as the roll size decreases to maintain the correct tension.

Figure 2A:
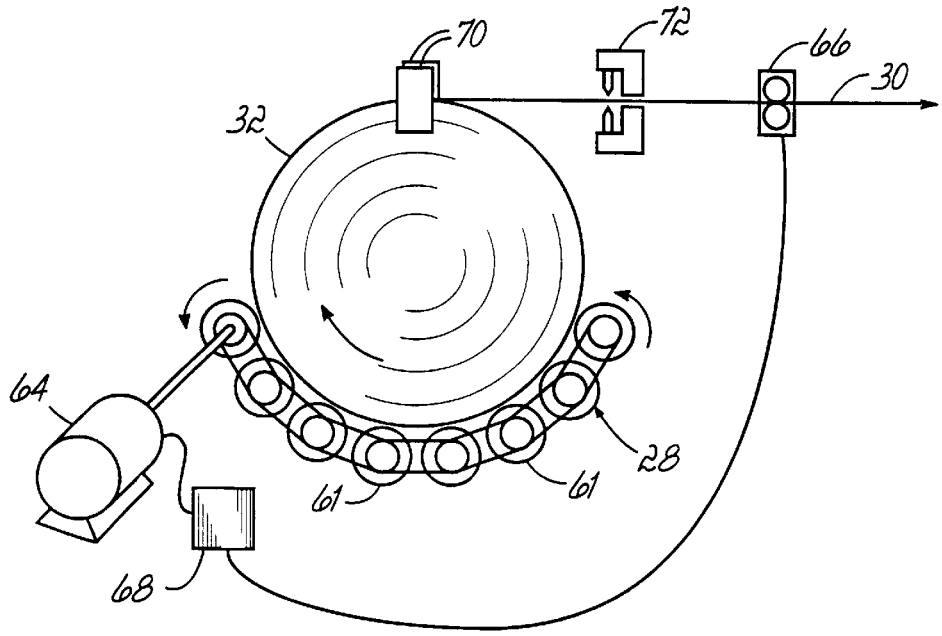
FIG. 2A is a schematic drawing showing additional components of a roll cradle of the system of FIG. 1 and having powered rollers.
Figure 2B:
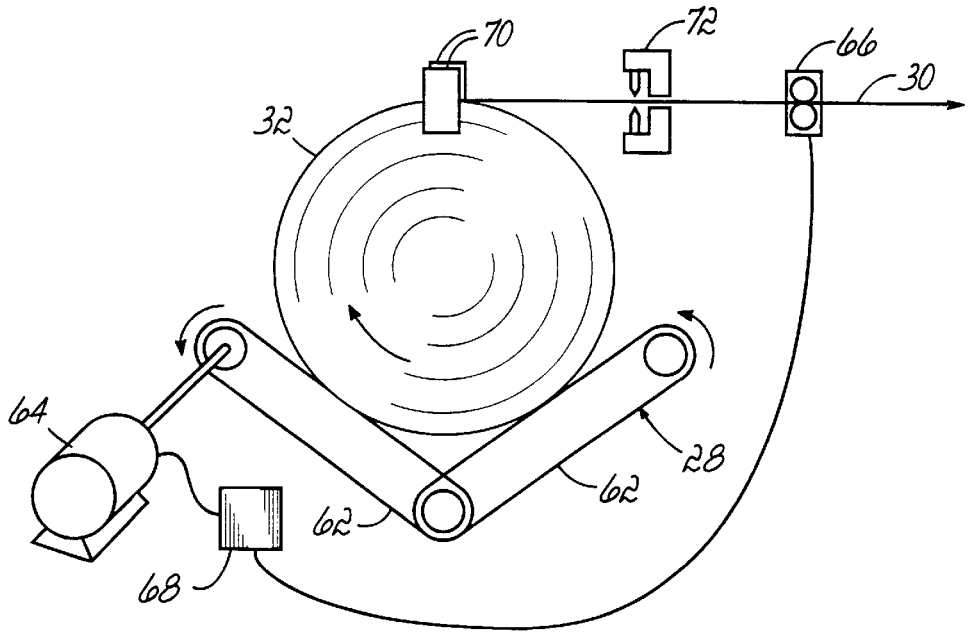
FIG. 2B is a schematic drawing similar to FIG. 2A and depicting a roll cradle with a powered belt drive.

FIGS. 2A and 2B show further detail of the roll cradle 28. Roll cradle 28 incorporates a power feed system which utilizes rollers 61 (as shown in FIG. 2A) or moveable belts 62 (as shown in FIG. 2B) arranged in a v-shape to accommodate various sized rolls 32 of fill material 30. Motor 64 drives the rollers 61 or belts 62 and is coupled with a sensor 66 and a controller 68. Sensor 66 monitors the tension in the fill material 30 dispensed from roll 32 and sends a signal to controller 68 to adjust motor 64 as necessary to eliminate tension in the material 30. Thus, the powered feed system unwinds the rolls 32 and feeds the material 30 into the quilting machine 12 in a more relaxed condition. The tendency for the roll 32 to over-run is eliminated, and the tension of the material 30 can be monitored and adjusted automatically and independent of roll size. Roll cradle 28 is also provided with edge guides 70 for adjusting the position of fill material 30 fed from the roll 32 to accommodate telescoping of material stored on the roll 32. Roll cradle 28 further may include a splicing and cutting device 72 for accommodating replenishment of roll 32 or for selectively cutting out material 30 from the infed fill material 20. After a cutting operation, motor 64 can be operated to rewind excess material 30 back onto the roll 32.

A foam log peeler 34, for example Sunkist model SA-5 available from Sunkist Chemical Machinery Ltd., Taipei, Taiwan, is an alternative way to supply foam filler materials to quilting machines. Whereas the roll cradle 28 handles rolls 32 of foam and/or fiber that are pre-manufactured to a specific thickness, the log peeler 34 cuts a continuous web from a solid log 36 of foam. The log peeler 34 automatically produces whatever thickness is required for any given product, and has the ability to accommodate on-the-fly changes during production. This eliminates the need to add or change rolls to obtain a required thickness, greatly reducing machine down time and operator fatigue. It also eliminates the need to stock all the different required thicknesses of foam. Crop-outs, which refers to the costly waste of material that results from a traditional changeover, could be greatly reduced and in some cases eliminated completely by use of the foam log peeler 34. The foam log peeler 34 may also be provided with a sensor and controller (not shown) to monitor the tension in the web of foam 38 and make adjustments to eliminate tension, as described above for the roll cradle 28.

Fan folded fill devices 40 are another option for providing raw fill material 20 to the quilting machine. In this case, the fill manufacturer creates a web of filler material 42 or a laminated sandwich of materials and provides it in a cart or bale form 44 that is fan-folded rather than wound onto a roll. In some applications, the carts 43 are easier to handle and store than rolls. The fan folded fill devices 40 eliminate the need for the fill supplier to restrict the total size and weight of the material to that which can be manually handled by the machine operators. Larger bulk quantities are also more cost-effective, especially for long production runs of the same product, due in part to fewer fill material changes. The fan folded fill material 42 may be provided with a trailing edge 45 extending from the cart 43 to allow the trailing edge 45 to be spliced to the leading edge of a subsequent bale of fill material (not shown) to permit uninterrupted feeding to the laminator 26. The fan folded fill device 40 may further be provided with a sensor and controller (not shown) to monitor the tension in the fill material 42 and make adjustments to eliminate tension, as described above for the roll cradle 28.

A fiber lay-down device 46 is yet another alternative to using pre-manufactured rolls of fiber, which are typically handled and fed into the quilting machine 12 in the same manner as foam fills and must be stocked in different densities and thicknesses. The fiber lay-down device 46 deposits the fiber material, when required, directly into the infeed web sandwich 56 to the required specification and thickness. Thus, the fiber fill material 48 is actually created on-site, thereby eliminating the need for stocking and handling of pre-manufactured fiber rolls. The fiber may be deposited onto the backing material 24 prior to entering the laminator 26, or may be deposited onto another fill material 30, 38, 42 being fed to the laminator 26 from one of the other devices 28, 34, 40, respectively, comprising the fill material supply device 14. Alternatively, a roll 49 of web material 50 may be provided in conjunction with the fiber lay-down device 46 for receipt of the fibers before the fibers enter the laminator 26. Fiber lay-down device 46 may be provided with a sensor and controller (not shown) to monitor the tension in the fiber fill material and make adjustments to eliminate the tension, as described above for the roll cradle 28.

Selection of fill materials 30, 38, 42, 48 for infed fill material 20 may be based on the desired quality and/or thickness of the final quilted product, or based on suitability for a given production run. For example, fill material 38 from one or more log peelers 36 may be selected when the quilting machine 12 will be used to produce several short runs of quilted product having varying thickness of foam fill material because foam material thickness may be changed at the log peeler 36 without the need to cut and splice the infed fill material 20. As another example, a fiber lay-down device 46 may be selected to be used in conjunction with a log peeler 36, to deposit a web of fiber fill material 48 on top of the foam fill material 38 from the log peeler 36, when a very thick layer of fill material 20 is desired for a given application. Alternatively, the fiber lay-down device 46 may deposit fiber directly between the cover material 22 and backing material 24 thereby allowing for a fiber layer to be created during production, and eliminating the need for pre-manufactured rolls of fill material.

Tick magazine 16 stores individual rolls 52 of various fabric cover material 22 in a carousel-style holder 54. An exemplary tick magazine is disclosed in U.S. Pat. No. 5,603,270, to White et al., and is incorporated herein by reference in its entirety. Rolls 52 of fabric cover material 22 are selectively fed to the laminator 26 from the tick magazine 16. The tick magazine stores, stages, feeds, cuts, splices and rewinds fabric cover material 22 as needed. Thus, various types of cover material 22 are readily available to be fed into the infeed web sandwich 56 to form the desired quilted product. The tick magazine 16 could include, for example, a roll 52 of each of jacquard, damask and knit to select from for the cover material 22 such that multiple short production runs could be performed continuously to manufacture a variety of quilted products. Alternatively, the tick magazine 16 could include multiple rolls 52 of the same type of cover material 22 to accommodate a long production run with a single cover material.

Figure 3:
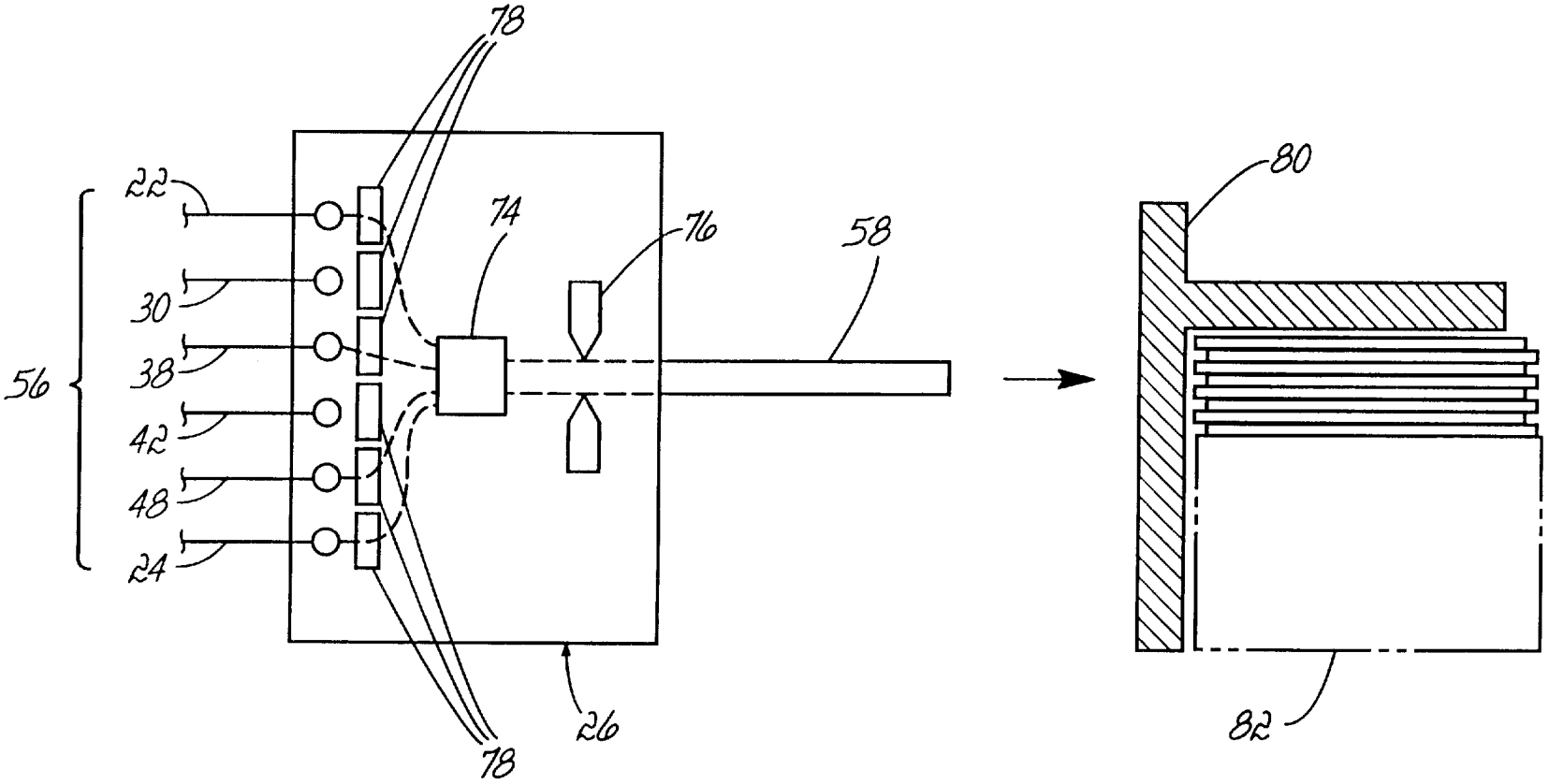
FIG. 3 is a schematic drawing showing additional components of a laminating machine of the system of FIG. 1.

Laminator 26, shown in further detail in FIG. 3, is located downstream of the fill supply system 14, tick magazine 16, and backing supply device 18. Laminator 26 receives infed cover material 22, fill material 20 and backing material 24 and channels the infeed web sandwich 56 into a continuous layered workpiece 58 of selected materials. The laminator 26 arranges the infed materials into a workpiece 58 and may or may not bond the materials, as described below. Laminator 26 is provided with individual cutting and splicing devices 78 for selectively cutting out or splicing in specific individual fill materials 30, 38, 42, 48 for fill material 20 as they are channeled to form the layered workpiece 58. In effect, laminator 26 acts as a switching station that controls which of the available fill materials 30, 38, 42, 48 are included in the laminated web or layered workpiece 58 for any given product. For example, FIG. 3 depicts operation of the laminator 26 to splice in fill materials 48 and 38 from the fiber lay-down device 46 and foam log peeler 34, respectively, and to cut out fill materials 30 and 42 from the roll cradle 28 and fan-folded fill device 40, respectively.

Alternatively, laminator 26 may be operated to provide a workpiece 58 comprised solely of fill materials. Such a workpiece 58 could be used as a "fill package" that would be processed into a finished quilted product at a later time.

Laminator 26 may include a glue station 74 which can be selectively actuated to apply glue to infed materials 56 to bond them together prior to sewing. Laminator 26 may also be provided with a panel cutting device 76 for alternatively providing cut-to-length panels 82 to the quilting machine 12, in place of a continuously fed workpiece 58. Laminator 26 may also be provided with a panel stacking device 80 which is designed to receive cut-to-length panels 82 provided from laminator 26 and stack them for use in quilting machine 12.

Layered workpiece 58 may then be fed into a digital printer 60 which is capable of printing a variety of colors and patterns onto the fabric cover material 22. An exemplary printer is described in U.S. Pat. No. 6,312,123, to Codos et al., and is herein incorporated by reference in its entirety. By printing directly to the cover material 22 prior to entering the quilting machine 12, the digital printer 60 eliminates the need for changing the fabric cover material rolls 52 to obtain different colors or patterns. The digital printer can also accommodate on-the-fly changes to the color or pattern. Though not depicted in the Figures, digital printer 60 could also be located upstream of the laminator 26 to print onto the cover material 22 received from the tick magazine 16 prior to its being fed to the laminator 26.

In use, the laminator 26 selectively receives one or more fill materials 20 from the fill material supply system 14. The infed fill materials 20 are fed together with a cover material 22 from tick magazine 16 and a backing material 24 from the backing supply device 18. Laminator 26 then channels the infeed web sandwich 56 into a layered workpiece 58*a*. The layered workpiece 58*a* may be provided in a continuous fashion to the digital printer 60 which imprints a selected color and/or pattern arrangement onto the cover material 22 of the layered workpiece 58*a*. After exiting the digital printer 60, the printed layered workpiece 58*b* is then fed for final processing into the quilting machine 12.

Figure 4:
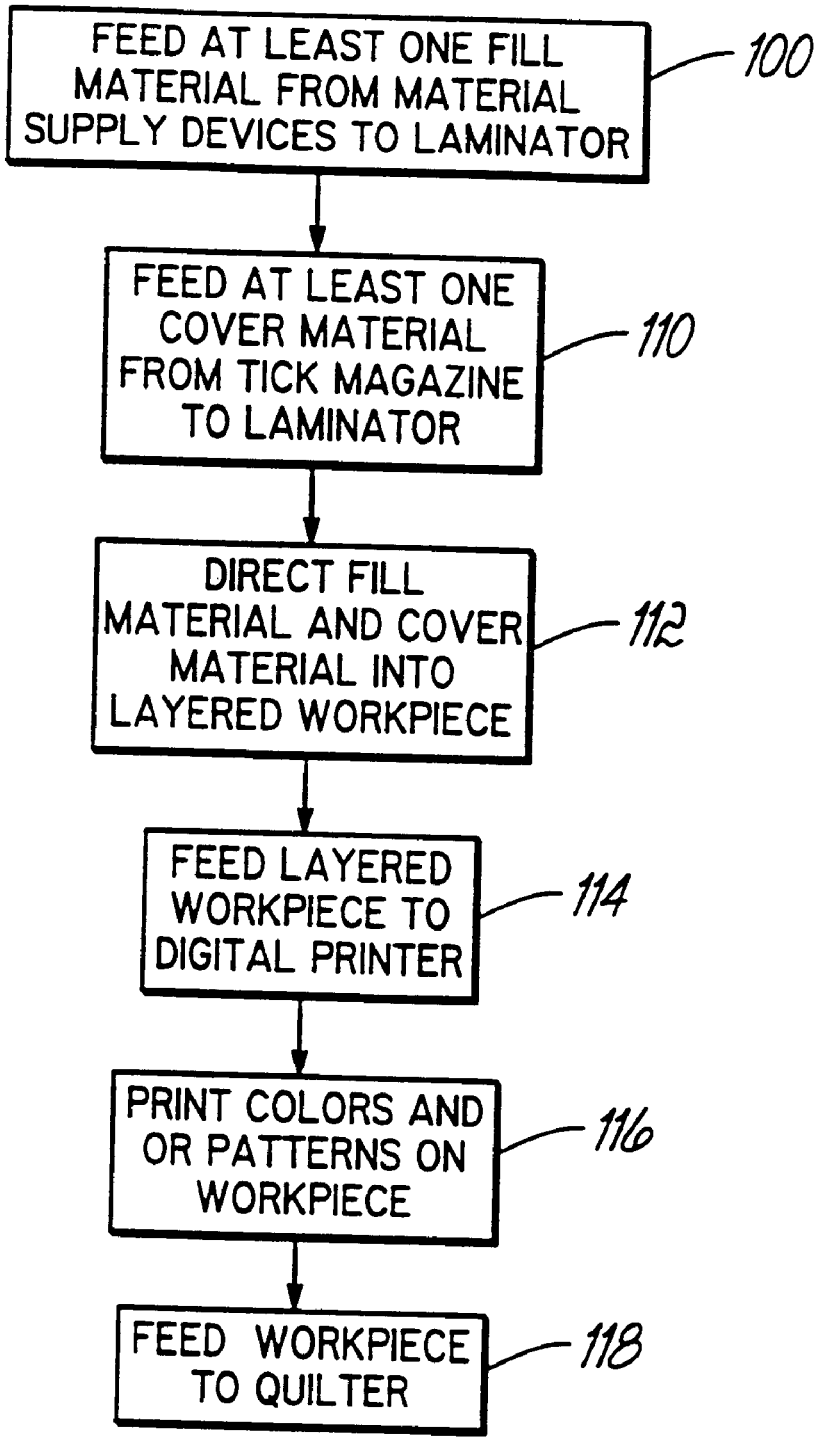
FIG. 4 is a flow diagram depicting an exemplary embodiment of the steps involved in feeding materials to a quilting machine from a modular material supply system of the present invention.

FIG. 4 depicts the general steps involved in supplying material to an automated quilting machine from a modular supply system, including a cradle for receiving and dispensing fill material in roll form, a foam log peeler, at least one fan-folded fill supply device, a fiber lay-down device, an automated tick magazine, and a fill laminator according to one embodiment of the invention. In particular, in step 100, at least one fill material from the material supply devices is fed to the laminator. In step 110, at least one cover material is fed to the laminator from the tick magazine. In step 112, infed fill and cover materials are directed into a layered workpiece. In optional step 114, the layered workpiece is fed to a digital printer. In step 116, colors and/or patterns are printed onto the workpiece. In step 118, the workpiece is fed to the quilter.

While the present invention has been illustrated by a description of various exemplary embodiments, and while these embodiments have been described in some detail, it is not the intention of the applicant to restrict or in any way limit the scope of the appended claims to such detail. Additional advantages and modifications will readily appear to those skilled in the art. This has been a description of the present invention along with the preferred methods of practicing the present invention as currently known. Various aspects of this invention may be used alone or in different combinations. The scope of the invention itself should only be defined by the appended claims wherein

We claim:

1. A modular system for continuously supplying material to an automated quilting machine, the modular system comprising:

a fill material supply system for receiving and holding various forms of fill material to be selectively supplied to the quilting machine, the fill material supply system including at least two components selected from the group consisting of: (a) a cradle for receiving and dispensing fill material in roll form, (b) a foam log peeling device for receiving foam fill material in solid log form and configured to cut away and dispense a continuous web of foam fill material at a desired thickness, (c) a fan-folded fill device for receiving and dispensing fill material folded into bale form, and (d) a fiber lay-down device for creating and dispensing fill material in fiber form;

an automated tick magazine for receiving and storing fabric cover material, staging and feeding the cover material for processing, cutting the cover material at a specified length, splicing newly selected cover material to the end of the material being fed into the laminating structure; and laminating structure downstream of the fill material supply system and automated tick magazine, the laminating structure constructed to select and receive at least one form of fill material from the fill material supply system and the fabric cover material from the tick magazine and to direct the fill material and the cover material into a layered workpiece for presentation to the quilting machine.

2. The system of claim 1 wherein the fill material supply system includes at least one each of components (a) and (b).

3. The system of claim 1 wherein the fill material supply system includes at least one each of components (a), (b) and (c).

4. The system of claim 1 wherein the fill material supply system includes at least one each of components (a), (b), (c) and (d).

5. The system of claim 1 wherein the fill material supply system includes at least one each of components (a) and (c).

6. The system of claim 1 wherein the fill material supply system includes at least one each of components (a), (c) and (d).

7. The system of claim 1 wherein the fill material supply system includes at least one each of components (a), (b) and (d).

8. The system of claim 1 wherein the fill material supply system includes at least one each of components (a) and (d).

9. The system of claim 1 wherein the fill material supply system includes at least one each of components (b) and (c).

10. The system of claim 1 wherein the fill material supply system includes at least one each of components (b), (c) and (d).

11. The system of claim 1 wherein the fill material supply system includes at least one each of components (b) and (d).

12. The system of claim 1 wherein the fill material supply system includes at least one each of components (c) and (d).

13. The system of claim 1 wherein the laminating structure further includes a glue station for selectively bonding the fill and cover materials prior to presentation to the quilting machine.

14. The system of claim 1 wherein the laminating structure further includes structure to cut out and splice in the various forms of fill material prior to presentation of the layered workpiece to the quilting machine.

15. The system of claim 1 wherein the laminating structure further includes a device for cutting and stacking individual panels of the layered workpiece.

16. The system of claim 1 wherein component (a) has a substantially concave shape for accommodating rolls of fill material placed into the cradle.

17. The system of claim 1 wherein component (a) is substantially v-shaped for accommodating rolls of fill material placed into the cradle.

18. The system of claim 16 wherein component (a) further includes a powered roller feed system adapted to unwind and feed material from a roll to the laminator and edge guides to compensate for material misalignment on the roll.

19. The system of claim 17 wherein component (a) further includes a powered belt feed system adapted to unwind and feed material from a roll to the laminator and edge guides to compensate for material misalignment on the roll.

20. The system of claim 1 wherein component (a) further includes a device for cutting and splicing fill material as it is dispensed from the cradle.

21. The system of claim 1 wherein component (a) further includes a sensor and a controller whereby the tension of the fill material being fed to the fill laminator can be monitored and adjusted.

22. The system of claim 1 further comprising a printer located downstream of the laminating structure and configured to print colors and patterns onto the fabric cover material prior to presentation of the workpiece to the quilting machine.

23. The system of claim 1 further comprising a printer located adjacent the tick magazine and configured to print colors and patterns onto the fabric cover material prior to feeding the cover material to the laminating structure.

24. The system of claim 1 further comprising a backing material supply device.

25. An apparatus for supplying raw material to an automated quilting machine, the apparatus comprising:

a fill laminator programmable to select at least one fill material, at least one backing material, and at least one cover material to be continuously fed to the laminator from upstream dispensing structure and to direct the infed raw materials into a layered workpiece for presentation to an automated quilting machine;

at least one cradle located upstream from the laminator and constructed to receive and hold fill material in roll form, the cradle having a powered feed system adapted to unwind and feed material from the roll to the laminator and edge guides to compensate for material misalignment on the roll;

at least one foam log peeler located upstream from the laminator for receiving and holding foam fill material in log form, the log peeler having a cutting edge substantially aligned with a longitudinal axis of the log adapted to cut a continuous web of fill material at a specified thickness as the log rotates about the longitudinal axis and to continuously feed the web of fill material subsequently to the laminator;

at least one fan-folded fill supply device located upstream from the laminator and constructed to receive and hold a continuous length of fill material that has been folded with alternating folds to create a stack of fill material adapted to be fed to the laminator;

at least one fiber lay-down device located upstream from the laminator and adapted to deposit fiber material at a desired thickness directly onto another material as it is fed into the laminator;

an automated tick magazine located upstream from the laminator and constructed to receive and store at least one fabric cover material, to stage and feed the cover material to the laminator, to cut the cover material to a specified length, to splice newly selected cover material to the end of the material being fed into the laminator, and to rewind unused cover material back into the magazine;

a backing material supply device; and a printer configured to print colors and patterns onto the fabric cover material prior to presentation of the layered workpiece to the quilting machine.

26. The apparatus of claim 25 wherein the fill laminator further includes a glue station for selectively bonding the layered workpiece prior to presentation to the quilting machine.

27. The apparatus of claim 25 wherein the fill laminator further includes a device to cut out and splice in fill materials from the at least one cradle, at least one foam log peeler, at least one fan-folded fill supply device and at least one fiber lay-down device prior to presentation of the layered workpiece to the quilting machine.

28. The apparatus of claim 25 wherein the fill laminator further includes a device for cutting and stacking individual panels of the layered workpiece.

29. The apparatus of claim 25 wherein the at least one cradle has a substantially concave shape for accommodating rolls of fill material placed into the cradle.

30. The apparatus of claim 25 wherein the at least one cradle is substantially v-shaped for accommodating rolls of fill material placed into the cradle.

31. The apparatus of claim 25 wherein the at least one cradle further includes a device for cutting and splicing fill material as it is dispensed from the cradle.

32. The apparatus of claim 25 wherein the at least one cradle further includes a sensor and a controller whereby the tension of the fill material being fed to the fill laminator can be monitored and adjusted.

33. The apparatus of claim 25 wherein the printer is located downstream of the laminator and is configured to receive the layered workpiece from the laminator to print colors and patterns onto the fabric cover material prior to presentation of the layered workpiece to the quilting machine.

34. The apparatus of claim 25 wherein the printer is located adjacent the tick magazine upstream of the laminator and is configured to print colors and patterns onto the fabric cover material prior to feeding the cover material to the laminator.

35. A modular system for processing in-fed materials into a quilting fill package which may be stored for subsequent processing in a quilting machine, the system comprising:

a fill material supply system for receiving and holding various forms of fill material to be selectively supplied to a laminator, the fill material supply system including at least two components selected from the group consisting of: (a) a cradle for receiving and dispensing fill material in roll form, (b) a foam log peeling device for receiving foam fill material in solid log form and configured to cut away and dispense a continuous web of foam fill material at a desired thickness, (c) a fan-folded fill device for receiving and dispensing fill material folded into bale form, and (d) a fiber lay-down device for creating and dispensing fill material in fiber form; and laminating structure downstream of the fill material supply system, the laminating structure constructed to select and receive at least one form of fill material from the fill material supply system and to direct the fill material into a layered workpiece.

36. The system of claim 35 wherein the laminating structure further includes a glue station for selectively bonding the fill and cover materials.

37. The system of claim 35 wherein the laminating structure further includes structure to cut out and splice in the various forms of fill material.

38. The system of claim 35 wherein the laminating structure further includes a device for cutting and stacking individual panels of the layered workpiece.

39. The system of claim 35 wherein component (a) has a substantially concave shape for accommodating rolls of fill material placed into the cradle.

40. The system of claim 35 wherein component (a) is substantially v-shaped for accommodating rolls of fill material placed into the cradle.

41. The system of claim 39 wherein component (a) further includes a powered roller feed system adapted to unwind and feed material from a roll to the laminator and edge guides to compensate for material misalignment on the roll.

42. The system of claim 40 wherein component (a) further includes a powered belt feed system adapted to unwind and feed material from a roll to the laminator and edge guides to compensate for material misalignment on the roll.

43. The system of claim 35 wherein component (a) further includes a device for cutting and splicing fill material as it is dispensed from the cradle.

44. The system of claim 35 wherein component (a) further includes a sensor and a controller whereby the tension of the fill material being fed to the fill laminator can be monitored and adjusted.

45. A method for continuously supplying material to an automated quilting machine from a modular material supply system having a cradle for receiving and dispensing fill material in roll form, a foam log peeler for receiving fill material in log form and dispensing a continuous web of fill material, at least one fan-folded fill supply device for receiving and dispensing fill material folded into bale form, a fiber lay-down device for dispensing fill material in fiber form, an automated tick magazine for receiving and dispensing cover material, and a fill laminator, the method comprising the steps of:

selectively feeding at least one fill material from at least one of the cradle, foam log peeler, fan-folded fill supply device, and fiber lay-down device to the fill laminator;

selectively feeding at least one cover material from the tick magazine to the fill laminator;

directing the fill and cover materials into a layered workpiece; and feeding the layered workpiece to the quilting machine.

46. The method of claim 45 wherein the system further includes a backing material supply device, the method further comprising:

selectively feeding backing material from the backing material supply device to the fill laminator; and directing the backing material with the fill and cover materials into a layered workpiece.

47. The method of claim 45 wherein the system includes a digital printer, further comprising:

feeding the layered workpiece to the digital printer; and selectively printing colors and patterns onto the cover material of the layered workpiece.

48. The method of claim 45 wherein the system includes a digital printer, further comprising selectively printing colors and patterns onto the cover material prior to feeding the cover material to the fill laminator.

* * * * *